United States Patent [19]

Horner

[11] 3,969,229

[45] July 13, 1976

[54] COMPONENT HANDLER WITH AUTOMATIC SORTER

[75] Inventor: James W. Horner, Long Beach, Calif.

[73] Assignee: GTI Corporation, Pittsburgh, Pa.

[22] Filed: Feb. 18, 1975

[21] Appl. No.: 550,479

[52] U.S. Cl. ..... 209/74 R; 209/81 R; 250/224; 250/491

[51] Int. Cl.[2] ..... B07C 5/08

[58] Field of Search ..... 209/73, 74 R, 74 M, 209/81; 193/31 R, 31 A; 250/224, 491

[56] References Cited

UNITED STATES PATENTS

| | | | |
|---|---|---|---|
| 2,885,076 | 5/1959 | House et al. | 209/81 R X |
| 3,366,235 | 1/1968 | Boyd et al. | 209/74 R |
| 3,677,401 | 7/1972 | Chaparro, Jr. et al. | 209/81 R |
| 3,750,880 | 8/1973 | Petrovsky | 209/74 R |

*Primary Examiner*—Allen N. Knowles
*Attorney, Agent, or Firm*—George F. Smyth

[57] ABSTRACT

A component handler including a supporting structure and a holder on the supporting structure for holding a plurality of components to be tested. After a group of the components in the holder are tested, they are automatically released from the holder and allowed to fall under the influence of gravity along associated component paths. A memory which is located along these component paths is programmed in accordance with the test results. As the components fall along the component paths, the memory automatically directs the components into collection zones whereby the components are sorted in accordance with the test results.

13 Claims, 8 Drawing Figures

19
21
23
25
31
33
45
47
49
51
53
55
57
58
59
61
63
64
65
71
73
75
77
79
81
83
85
87
91
93
95
97
99
101
103
104
104a
105
106
106a
107
109
111
4
4

COMPONENT HANDLER WITH AUTOMATIC SORTER

BACKGROUND OF THE INVENTION

Various electrical components such as capacitors, diodes, and resistors are often made in the form of very small chips. Before using the components, they must be subjected to various electrical tests and then sorted in accordance with the results of the tests. For example, a capacitor may be tested for capacitance, flash, the amount of charge lost over a predetermined time period, etc. The sorting process may involve separating the acceptable components from the rejects or in separating all components for which the test results are similar.

Typical prior art component handlers provide for testing and sorting only one component at a time. For example, one prior art component handler sequentially picks up the component, moves the component to a test jig where a tester electrically tests the component, and then moves the component to an appropriate bin depending upon the test results.

Common assignee's copending application Ser. No. 415,741, filed on Nov. 14, 1973, now U.S. Pat. No. 3,915,850, issued Oct. 28, 1975, and entitled "Component Handler And Method And Apparatus Utilizing Same", and common assignee's copending application Ser. No. 472,978, filed on May 25, 1974, and entitled "Component Handler With Fluid Controlled Memory" disclose component handlers which enable the tester to work at a greater speed to thereby substantially increase the testing rate. In addition, these component handlers greatly increase the sorting rate.

With the above mentioned copending applications, the testing rate is increased by retaining a large number of components in a holder and by rapidly sequentially electrically coupling each component to a tester which performs whatever tests are desired. To increase the sorting rate, the test results are stored in a memory. The programmed memory is then used to selectively remove components from the holder in accordance with the test results.

In order to permit the memory to remove components from the holder, the memory includes a body and a plurality of memory members or ejector members, and the holder has a plurality of openings therein adapted to receive the components, respectively. The openings and the ejector members are arranged in substantially identical patterns. The programming of the memory includes positioning of the ejector members in either an extended or retracted position. After the memory is fully programmed, the memory and holder are juxtaposed so that the ejector members in the ejecting position can extend into the corresponding openings of the holder to eject the associated components into an appropriate bin.

SUMMARY OF THE INVENTION

The component handlers of the above-mentioned copending applications provide a substantial advance in the art. However, they do require juxtaposing of the holder and the programmed memory so that the memory can appropriately eject the tested components.

The present invention further reduces sorting time by eliminating the need to juxtapose the holder and the programmed memory following testing in order to sort the tested components. With this invention, components are sorted automatically. The elimination of ejecting components with the memory also eliminates another possibility for error in the sorting operation.

These concepts can be embodied in a component sorting apparatus which includes a holder or holding means for holding a plurality of components to be tested at holding locations. The components in the holder are tested by relatively moving a test member such as a test contact and the holder. The holder, the test member, or both the holder and test member may be moved relative to fixed supporting structure. After a predetermined number of components, such as one row of components, has been tested, such predetermined number of components are released from the holder. The released components move along component paths, respectively. Programmable means are responsive to the results of the tests of each of the components for directing the components from the component paths into separate zones, such as collection zones. This results in the components being sorted automatically in accordance with the results of the test. The components are sorted as they are conveyed along the component paths rather than by selective ejection from the holder.

The holder can advantageously include movable means such as a plate for releasing the components. For example the plate may be moved to sequentially release the rows of components in the holder. The released components can advantageously move under the influence of gravity along the associated component paths. The programmable means may also be moved from row to row and this reduces the number of parts required for the programmable means.

The programmable means can advantageously include a plurality of movable members mounted on a mounting member. The collection zones are in communication with the component paths. The movable members of the programmable means are movable into and away from the component paths. Means is provided which is responsive to the positions of the movable members for controlling the collection zones into which the components move from the component paths. Although this last mentioned means may take different forms, in a preferred embodiment, it includes deflecting surfaces on the movable members for deflecting the components from the component paths toward selected collection zones.

The necessary relative movement between the holder and test member can be provided by an $x$–$y$ table having drive means constructed in accordance with this invention. One feature of the drive means is that a single motor is used to relatively drive the test member and the holder back and forth without reversing of the motor. This permits components to be scanned as the test member is moved in both directions relative to the holder.

Another feature of the drive mechanism is that the indexing motion for relatively moving the holder and test member to index the test member between rows of components in the holder is also accomplished using the above-mentioned motor. This can advantageously be carried out by utilizing a single revolution clutch which is operative at the end of each row of components to relatively index the test member and the holder.

After all of the components in the holder have been tested, the same motor can also be used to return the holder to the starting position relative to the test member. This is accomplished by reversing the motor and utilizing a one-way clutch to prevent the test member from being driven in its scanning motion.

The invention can best be understood by reference to the following description taken in connection with the accompanying illustrative drawing.

DESCRIPTION OF THE PREFERRED EMBODIMENT

Figure 1:
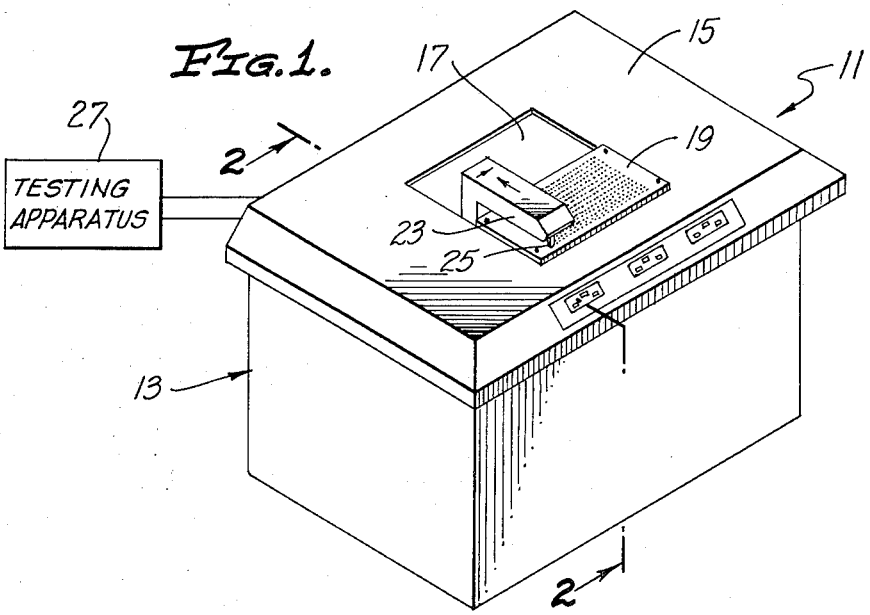
FIG. 1 is an isometric view of a component handler constructed in accordance with the teachings of this invention.
Figure 2:
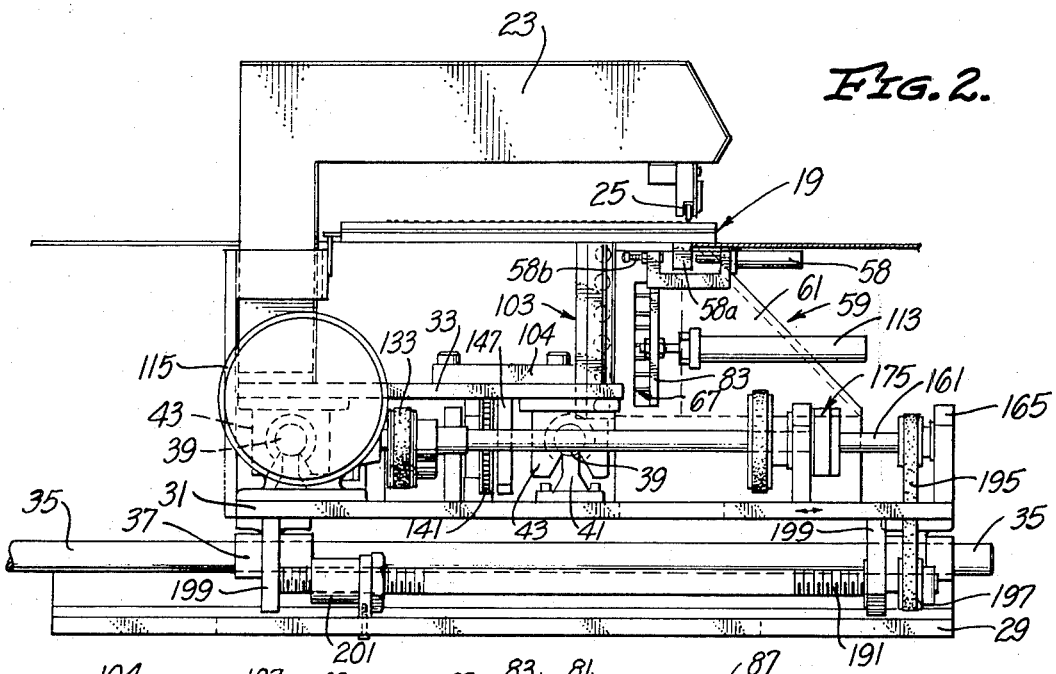
FIG. 2 is an enlarged fragmentary sectional view taken generally along line 2—2 of FIG. 1.
Figure 3:
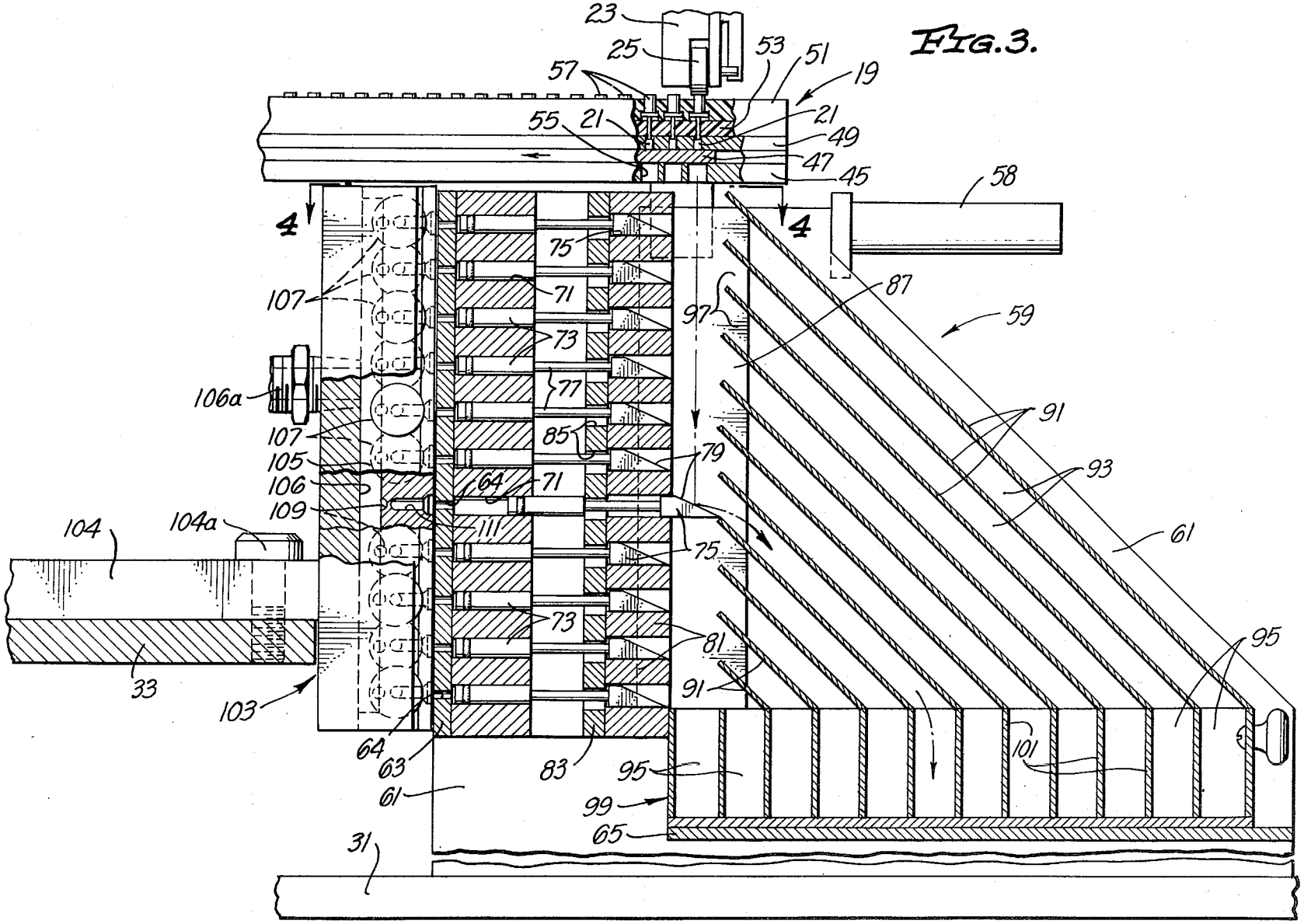
FIG. 3 is an enlarged fragmentary sectional view of the portions of the component handler for holding and sorting the components.
Figure 5:
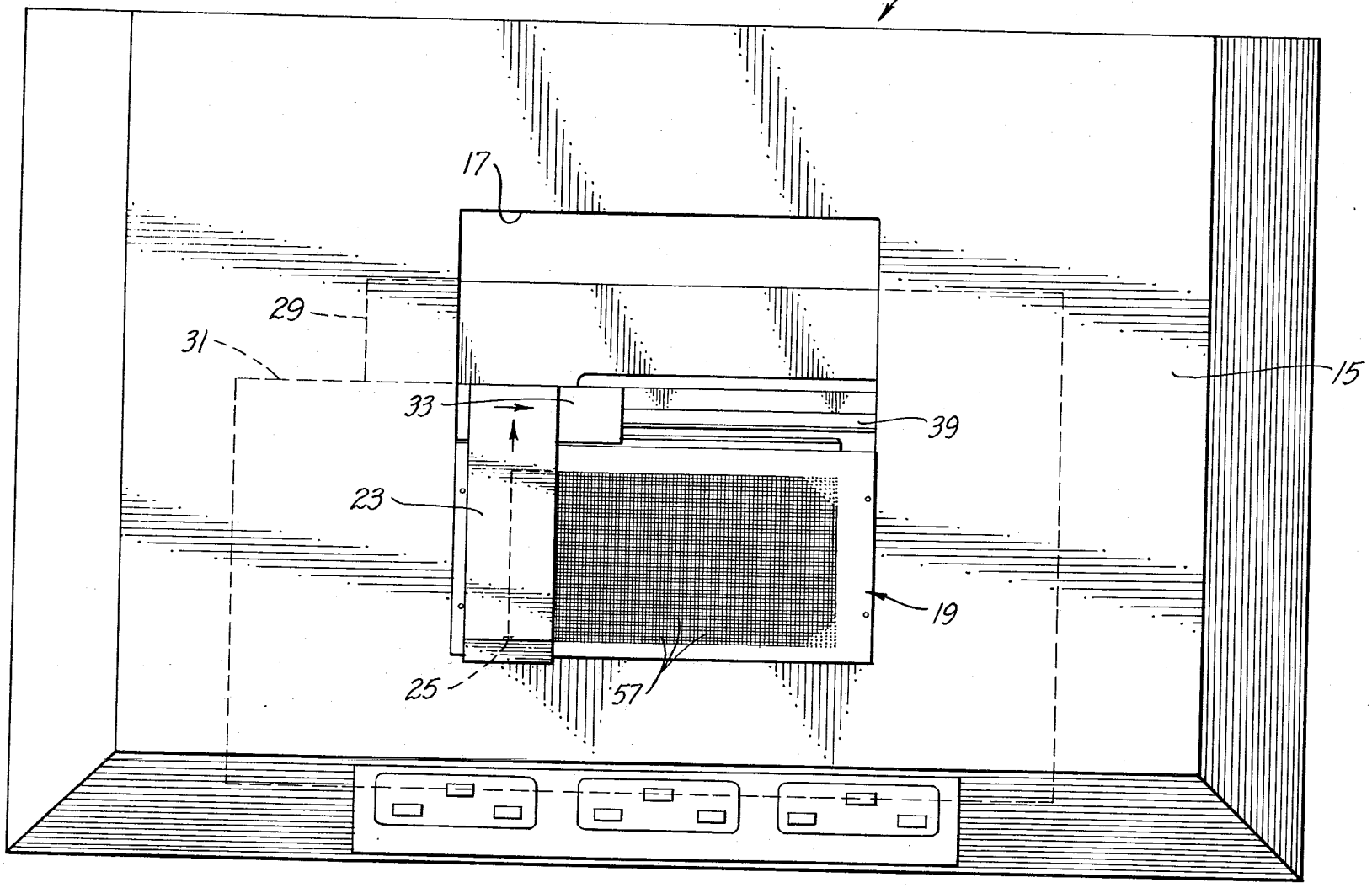
FIG. 5 is a plan view of the component handler.

FIG. 1 shows a component handler 11 which includes a cabinet 13 having a top wall 15 with an opening 17 therein. The component handler 11 also includes a holder 19 fixedly mounted with respect to the cabinet 13 for holding a plurality of components 21 (FIG. 3) in a plurality of parallel rows. An arm 23 which projects through the opening 17 is mounted for movement along the rows of components 21 and for movement transverse to the rows of components. The arm 21 carries a test contact or scanning member 25 (FIGS. 1–3). The component handler 11 is adapted for use with another item of equipment such as a testing apparatus 27.

The component handler 11 is adapted to test and sort a variety of components, such as capacitors, diodes, and resistors. In operation, the arm 23 moves the test contact 25 back and forth across the rows of components 21 to test all of the components retained in the holder 19. The component handler 11 automatically sorts the components 21 following the test.

Figure 6:
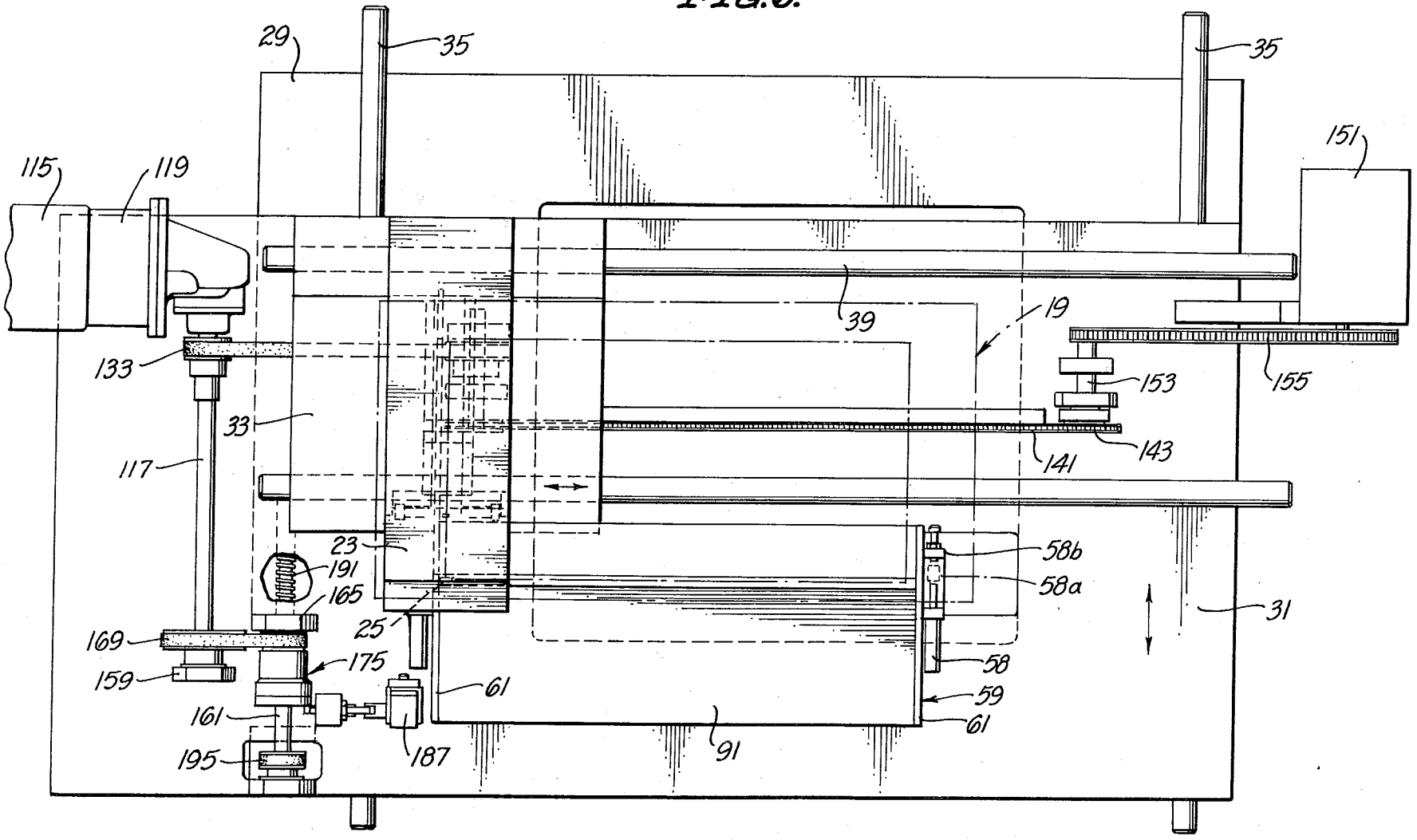
FIG. 6 is a fragmentary plan view of the component handler with the top of the cabinet and the holder removed.

With reference to FIGS. 2 and 6, the component handler 11 includes a fixed supporting structure 29 suitably mounted within the cabinet 13. An *x–y* table which includes a lower plate 31 and an upper plate 33 is mounted on the supporting structure 29. In the embodiment illustrated, parallel shafts 35 are suitably fixedly mounted on the supporting structure 29, and the lower plate 31 is mounted on the shaft 35 by appropriate bearings 37 (FIG. 2) for movement along the shafts. Similarly, shafts 39 are fixedly mounted as by brackets 41 (FIG. 2) on the lower plate 31 in a direction perpendicular to the shafts 35. The upper plate 33 is mounted by appropriate bearings 43 on the shafts 39 for movement therealong. A preferred drive mechanism for moving the plates 31 and 33 is described hereinbelow.

The arm 23 is suitably mounted on the upper plate 33 as shown in FIG. 2. Accordingly, the motion of the two plates 31 and 33 is transmitted to the arm 23 and hence to the test contact 25. Specifically, movement of the upper plate 33 moves the test contact 25 along a selected row of the components 21, and movement of the table 31 indexes the test contact 25 between adjacent rows of the components.

The test contact 25 shown in FIG. 3 is in the form of a wheel 27 rotatably mounted on the arm 23. However, the test contact 25 may be of various other constructions, such as a sliding contact.

With reference to FIG. 3, the holder 19 includes a fixed plate 45, a slidable release plate 47, a holding plate 49, and insulating plates 51 and 53. The fixed plate 45 is suitably affixed to the supporting structure 29. The fixed plate 45 has a plurality of apertures 55 therein with one of the apertures lying directly beneath one of the components 21.

The holding plate 49 is suitably fixedly mounted on the fixed plate 45. The holding plate 49 contains a plurality of passages arranged in parallel rows. Each of these passages in the holding plate 49 defines a holding location and is adapted to receive one of the components 21. In the position shown in FIG. 3, the release plate 47 closes the bottom of the passages in the holding palte 49 to prevent the components 21 from falling out of their respective openings. The release plate 47 is suitably mounted for sliding movement relative to the holding plate 49 and the fixed plate 45. Accordingly, by moving the release plate 47, the components 21 can be selectively allowed to drop out of the holder 49.

The insulating plates 51 and 53 are permanently bonded together, and they are releasably mounted on the holding plate 49 in any suitable manner such as by plurality of cooperating dowels (not shown). This may be accomplished in the manner described more fully in common assignee's copending application Ser. No. 472,978. With the plates 49 and 51 removed as permitted by these dowels, the components 21 can be loaded into the openings in the holding plate 49 using various known methods including the method described in common assignee's copending application Ser. No. 415,741.

A primary function of the insulating plates 51 and 53 is to mount contacts 57, one of which is provided for each of the components 21. Although the contacts 57 could take various different forms, in the embodiment illustrated, each of them is in the form of an elongated stem, the inner end of which is adapted to make electrical contact with the component 21 and the outer portion of which protrudes upwardly above the insulating plate 53 as shown in FIG. 3. Each of the contacts 57 is slightly axially slidable within the insulating plates 51 and 53. The insulating plates 51 and 53 are constructed of insulating material, and they electrically insulate the contacts 57 from each other.

The release plate 47 is conductive. Accordingly, a circuit can be completed from the testing apparatus 27 through the test contact 25, the contact 47 which is engaged by the test contact, the associated component 21, and the release plate 47 back to the testing apparatus. As the contacts 57 and the passages in the holding plate 49 are provided in identical patterns, the testing apparatus 27 can be sequentially electrically coupled to each of the components 21 by moving the test contact 25 sequentially into engagement with each of the contacts 57. In this manner, each of the components 21 can be tested. It should be noted that each of the components 21 will be of the type which can be electrically coupled into a circuit by contact with oppositely located regions thereof. One example of this type of component is shown and described in common assignee's copending application Ser. No. 472,978.

The release plate is suitably slidably mounted on the fixed plate 45. The release plate 47 can be moved in various different ways to achieve release of the tested components 21. In the embodiment illustrated, the release plate 47 is indexed by a pneumatic actuator 58 (FIGS. 2, 3, and 6) which is suitably carried by the plate 31 and which cooperates with a tab 58*a* (FIGS. 2 and 6) on the release plate. The length of the indexing motion can be adjusted by a threaded adjustment 58*b* suitably carried by the plate 31 and located on the side of the tab 58*a* opposite the actuator 58. Thus, each time the actuator 58 is operated, the release plate 47 is moved to the left as viewed in FIG. 3 to release the row of components 21 which has just been tested. Each of the released components 21 is then free to fall under the influence of gravity through the associated aperture 55 of the fixed plate 45 into sorting means 59 (FIG. 3).

The sorting means 59 includes spaced parallel side plates 61 (FIGS. 2, 3, 4 and 6) joined by an end plate 63 and a plate 65 (FIGS. 4 and 6) having a plurality of apertures 64, and a bottom plate 65 (FIG. 3). The side plates 61 are suitably fixedly mounted on the supporting structure 29. A plurality of movable memory members 67 are mounted for linear movement along parallel paths by a mounting member or mounting plate 69. In the embodiment illustrated, the mounting plate 69 includes a plurality of parallel cylindrical passages 71 arranged in a plurality of vertical columns, with one of the columns being provided for each of the components 21 in a given row of components. Although the memory members 67 could take different forms, in the embodiment illustrated, each of the memory members 67 includes a piston portion 73 adapted to be slidably received in the passages 71, respectively. Each of the memory members 67 also includes, by way of example, a head 75 joined to the associated piston portion 73 by a stem 77 of reduced cross sectional area. Although various different constructions could be utilized, in the embodiment illustrated, each of the heads 75 has a deflecting surface 79.

The sorting means 59 also includes a plurality of vertically spaced parallel bars 81 with a horizontally arranged row of the heads 75 of the memory members 67 being received between each adjacent pair of the bars 81. The bars 81 and the mounting plate 69 are suitably mounted on the side plates 61 with the bars being horizontally spaced from the plate 69. A reset member 83 in the form of a plate is mounted on the side plate 61 in any suitable manner for movement between the bars 81 and the mounting plate 69. The reset member 83 has a plurality of apertures 85 for receiving the stems 77, respectively. The apertures 85 are sized and arranged relative to the piston portions 73 and the heads 75 so that neither the piston portion nor the head can pass therethrough.

A plurality of vertically extending shims 87 (FIGS. 3 and 4) define component passages 89 with one of the component passages 89 being provided for and lying immediately beneath each of the components 21 in one row of the components. Each of the shims 87 is slotted to receive at least portions of the bars 81 and portions of chute plates 91 to thereby mount the shims.

In order for the components 21 to be sorted, the sorting means 59 must define separate zones into which the components can be directed in accordance with the results of the test. In the embodiment illustrated, such separate zones include parallel passages 93 defined by adjacent pairs of chute plates 91 and collection zones 95 communicating with the passage 93. Each of the chute plates 91 is suitably fixed to the side plates 61. Each of the passages 93 extends completely and continuously between the side plates 61. Thus, each of the passages 93 has an inlet 97 which communicates with each of the component passages 89. Moreover, each of the inlets 97 lies adjacent one of the memory members 67 and is adapted to cooperate therewith in a manner described hereinbelow.

Although the collection zones 95 could be defined in different ways, in the embodiment illustrated, these zones are provided in a drawer 99 which is suitably slidably mounted on the end plates 61 so that it can be removed from the remainder of the sorting means 59. Specifically, the collection zones 95 are defined by spaced parallel plates 101 within the drawer 99.

Figure 4:
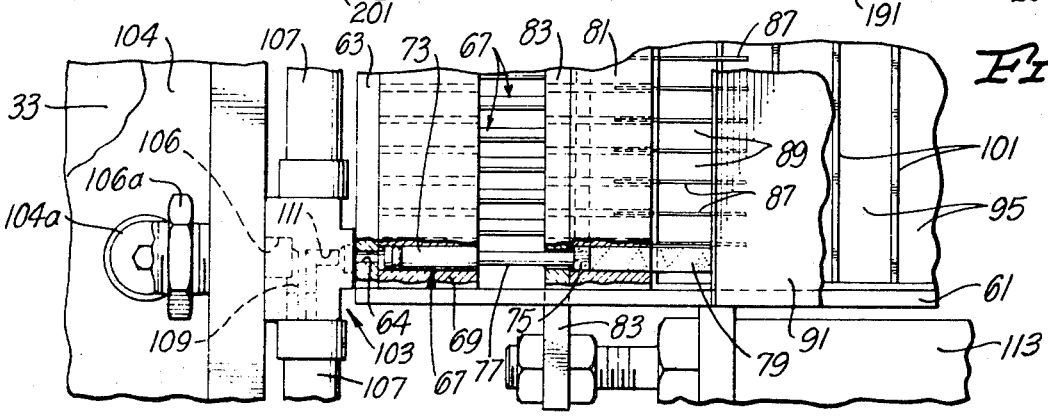
FIG. 4 is an enlarged fragmentary sectional view with parts broken away taken generally along line 4—4 of FIG. 3.

Thus, the sorting means 59 provides one vertical column of the movable memory members 67 for each of the components 21 in a row of the components. The memory members 67 of a column are programmed in accordance with the results of the test of the associated component 21. In the embodiment illustrated in FIG. 3, the programming of the memory members 67 involves linearly moving selected ones of the memory members, and this can advantageously be carried out by an air nozzle assembly 103 (FIGS. 3 and 4).

The air nozzle assembly 103 is mounted on the upper plate 33 for movement therewith by a mounting bracket 104 and fastener 104*a*. The air nozzle assembly 103 includes a body 105 having an elongated manifold 106 which receives air under pressure from an air source (not shown) through an inlet fitting 106*a*. A plurality of solenoid operated air valves 107 are mounted on the body 105. In response to an appropriate signal from the testing apparatus 27, an appropriate one of the solenoid valves 107 opens momentarily to provide a blast of air from the manifold 106 through a port 109 within the body 105, the selected valve 107, a port 111 in the body, the associated aperture 64, and the associated one of the passages 71 in the mounting plate 69. One set of the ports 109 and 111 is provided for each of the memory members 67 in the adjacent column of memory members with each of the ports 109 communicating with the manifold 106 in the body 105. The air acts on the piston portion 73 in the passage 71 to move the associated memory member 67 to the right from the retracted position to an extended position. One of the memory members 67 is shown in the extended position in FIGS. 3 and 4. In the extended position, the outer end of the memory member engages one of the chute plates 91. Only one of the memory members 67 in each vertical column needs to be moved to the extended position, and if the component 21 is to be directed to the collection zone 95 at the extreme left end of the drawer 99 as viewed in FIG. 3, none of the memory members needs to be moved to the extended position.

Because the air nozzle assembly 103 is mounted on the upper plate 33, it is moved from a position of communication with one vertical column of the memory members 67 to an adjacent vertical column of the memory members as the test contact 25 is moved from one of the contacts 57 to an adjacent contact 57. At this new position, a second one of the components 21 is tested and an appropriate one of the solenoid valves 107 is momentarily opened to move one of the memory members 67 of the second column of memory members to the extended position all in accordance with the results of the test of such component.

When the test contact 25 tests the last component 21 in the first row, the release plate 47 is moved to the left as viewed in FIG. 3 by the actuator 58 which extends to engage the tab 58*a* and move the latter until it engages the adjustment 58*b*. This moves the release plate 47 to remove the support for the first row of components 21, all of which have been tested, and permits these components to fall under the influence of gravity along component paths and into the component passages 89 (FIGS. 3 and 4). Each of these components 21 falls in its component passage until it strikes the deflecting surface 79 of the associated movable memory member 67 which is in the extended position. The deflecting surfaces 79 deflect the components 21 striking them into an associated one of the passages 93. The components slide down the passages 93 and into the associated collection zones 95. In this manner, all of the components 21 in a row are sorted simultaneously in accordance with the test results.

After the components 21 in the first row of components have been sorted, an actuator 113 (FIG. 4), which may be mounted on one of the side plates 61 is energized to move the reset member 83 from the position shown in FIGS. 3 and 4 to a position contiguous the plate 69 and then back to the position shown in FIGS. 3 and 4. This reciprocating motion of the reset member 83 returns all of the movable memory members 67 which are in the extended position back to the retracted position. Following this, the lower plate 31 is indexed to move the test contact 25 into engagement with the adjacent contact 57 of the adjacent row of contacts whereupon the test contact 25 is moved in the opposite direction along the second row of contacts 57 and the above described operation is repeated.

The movements of the test contact 25, the sorting means 59, and the air nozzle assembly 103 are provided by the *x–y* table which comprises the lower plate 31 and the upper plate 33. Although the plates 31 and 33 can be driven in different ways, the drive mechanism illustrated in FIGS. 6–8 possesses certain advantages.

The drive mechanism includes a reversible motor 115 (FIG. 6) suitably mounted on the lower plate 31. The motor 115 drives a shaft 117 by way of a gear reduction unit 119, a stub shaft 121 (FIG. 7), and a coupling 123. To drive the upper plate 33, a pulley 125 is fixedly mounted on the stub shaft 121. A shaft 127, which is suitably mounted on the lower plate 31 as by blocks 129 and bearings 131 is driven by the pulley 125 by way of a belt 133, a pulley 135, and a one-way clutch 137. Thus, the motor 115 (FIG. 6) drives the shaft 127 when the motor is rotating in one direction. However, when the motor 115 rotates in the opposite direction, the one-way clutch 137 is disengaged so that the shaft 127 is not driven. Thus, the shaft 127 is driven unidirectionally and only in response to rotation of the motor 115 in one direction.

A sprocket 139 is affixed to one end of the shaft 127. A chain 141 is driven by the sprocket 139 and drives a sprocket 143 (FIG. 6). A drive pin 145 (FIGS. 7 and 8) is carried by the chain 141 and projects outwardly of the chain. The upper plate 33 has a block 147 suitably fixed to the underside of the upper plate. The block 147 has an elongated vertical slot 149 which is sized to slidably receive the drive pin 145.

The cooperation between the drive pin 145 and the surfaces defining the slot 149 enables the chain 141 to drive the upper plate 33 back and forth without reversing the direction of the motor 115. For example, with the shaft 127 being driven in the direction indicated by the arrow in FIG. 8, the upper plate 33 would be driven to the left as viewed in FIG. 8. When the block 147 reaches the sprocket (FIG. 6) the direction of movement of the block and the plate 33 would be reversed. Another advantage of this construction is that it smoothly reverses the direction of movement of the upper plate 33.

In addition to driving the upper plate 33, the chain 141 is also used to drive a sequence programmer 151 (FIG. 6). In the embodiment illustrated, the sequence programmer 151 is driven by the chain 141 through the sprocket 143, a shaft 153 which is suitably mounted on the lower plate 31, and a chain drive 155 drivingly coupled to the shaft 153 and the sequence programmer.

The sequence programmer 151 contains the necessary controls for automatically controlling the operation of the component handler 11. For example, the programmer 151 provides signals to operate the actuator 113 for the reset member 83, to operate the actuator 58 to operate the release plate 47, and to control the timing of the indexing movements of the lower plate 31. Many different kinds of pneumatic controls or electrical relay control circuits or logic circuits can be utilized to sequence these events, and the particular controls form no portion of this invention.

Figure 7:
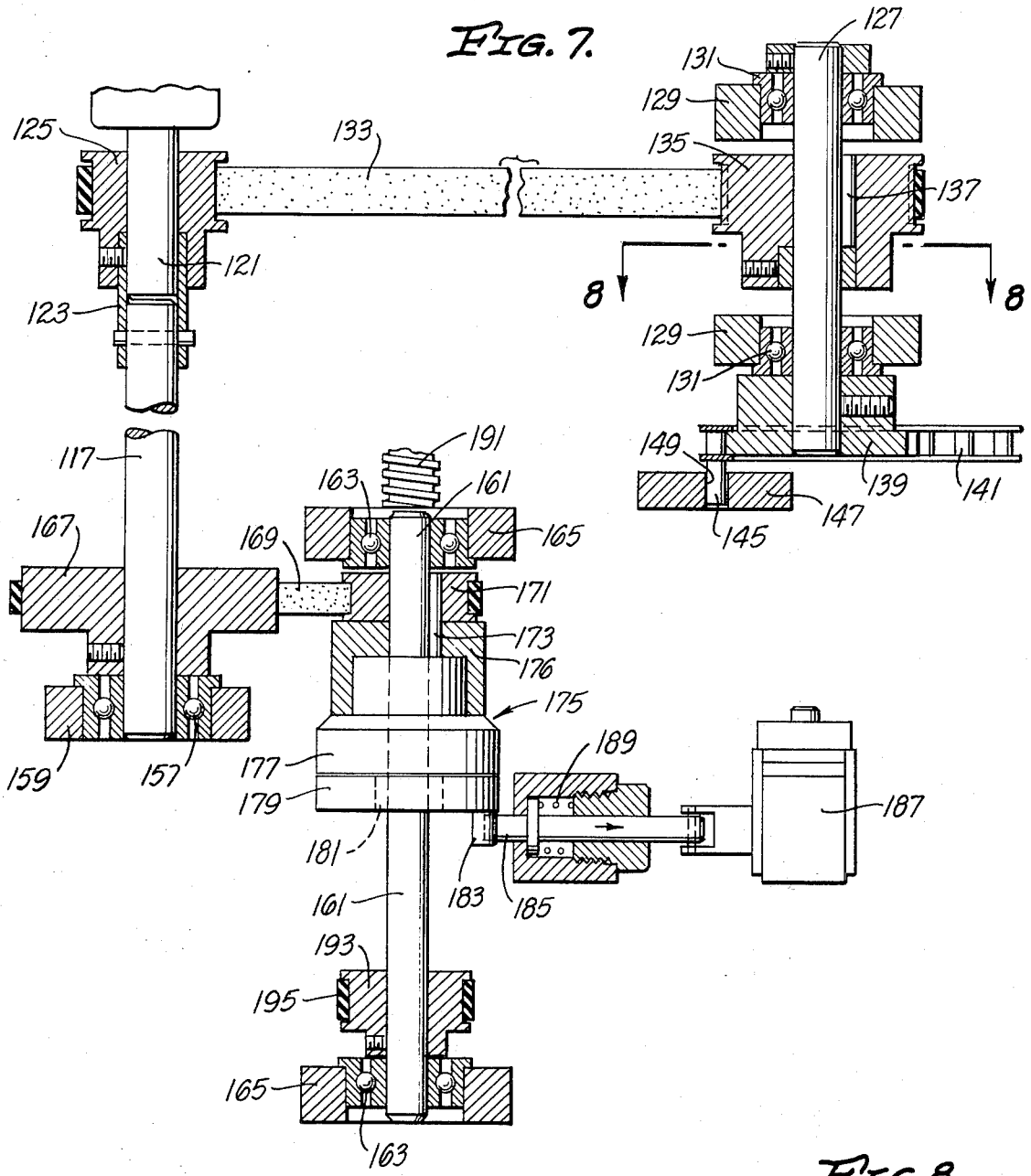
FIG. 7 is a sectional view illustrating the drive means for the *x–y* table of the component handler.
Figure 8:
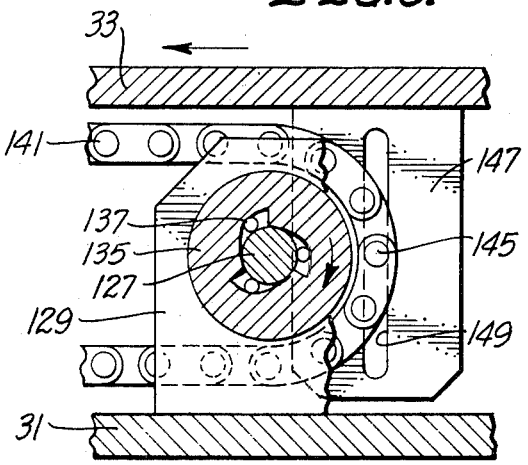
FIG. 8 is a sectional view taken generally along line 8—8 of FIG. 7.

The motor 115 is also utilized to index the lower plate 31. As shown in FIGS. 6 and 7, the shaft 117 is supported at one end by the coupling 123 and at the other end by a bearing 157 which is mounted in a block 159 which is in turn mounted on the lower plate 31. A shaft 161 is rotatably mounted by bearings 163 which in turn are mounted on the lower plate 31 by blocks 165. A pulley 167 is mounted on the shaft 117 and drives a belt 169 which in turn drives a pulley 171, the latter being mounted on the shaft 161 by a one-way clutch 173. A one revolution clutch 175 which may be of conventional design is mounted on the shaft 161. The one revolution clutch 175 includes an adapter 176 mounted on the shaft 161 by the one-way clutch 173 and directly coupled to the pulley 171, a clutch plate 177 directly coupled to the adapter 176 and a clutch plate 179 mounted on the shaft 161 by a one-way clutch 181 which is arranged to drive in a direction opposite to the direction in which the clutch 173 drives. The clutch plate 177 frictionally drives the clutch plate 179, but these two clutch plates slip in a well known manner at a predetermined torque magnitude.

With the motor 115 turning in the direction to reciprocate the upper plate 33, power is simultaneously transmitted to the clutch plate 179 via the pulley 171, the adapter 176, and the clutch plate 177. During this time the one-way clutch 173 free wheels so the shaft 161 is not driven. The clutch plate 179 is held against rotation by a tab 183 on the clutch plate and a detent 185. At the appropriate instant at the end of each stroke of the upper plate 33, the sequence programmer 151 provides a signal to momentarily energize a solenoid 187 to thereby retract the detent 185 against the biasing action of a spring 189. This frees the tab 183 and the clutch plate 179 for rotation through a single revolution. The clutch plate 179 drives the shaft 161 through the one-way clutch 181. Before the clutch plate 179 can turn through more than one revolution, the detent 185 is returned to its locking position as shown in FIG. 7.

This one revolution of the clutch plate 179 and of the shaft 161 is utilized to index the lower plate 31. Although this can be accomplished in different ways, in the embodiment illustrated, this motion is transmitted to a screw 191 (FIG. 2) by way of a pulley 193 (FIG. 7) on the shaft 161, a belt 195, and a pulley 197 (FIG. 2) drivingly coupled to the screw 191. The screw 191 is suitably rotatably mounted on and beneath the lower plate 31 in any suitable manner such as by mounting blocks 199 (FIG. 2). A nut 201 (FIG. 2) is fixedly mounted on the supporting structure 29 and cooperates with the rotatable screw 191 so that one revolution of the latter moves the lower plate 31 an amount corresponding to the spacing between adjacent rows of the contacts 57 of the holder 19.

The component handler 11 can be used with many different testing apparatuses 27. Generally, the testing apparatus 27 should be capable of performing the test rapidly and of providing a test signal indicative of the test. By way of illustration, if the component 21 being tested is a capacitor chip, the testing apparatus may perform various relevant tests to determine, within certain tolerances, the capacitance rating and dissipation factor. A testing apparatus which will perform these functions and provide a testing signal for each component tested is known as the model 5311 and is available from Micro Instruments, Hawthorne, Calif. Other testing apparatuses which would perform other functions may be used if desired.

In operation of the component handler 11, the plates 51 and 53 (FIG. 3) are removed from the holder 19, and the components 21 are loaded into the passages of the holding plate 49 with one of the components being in each of the passages. This loading operation can be carried out in accordance with conventional mass loading techniques.

At the beginning of the test, the test contact 25 is at a first of the contacts 57 in the first row of the components 21, and all of the memory members 67 are in the retracted position. The release plate 47, the reset member 83, and the air nozzle assembly 103 are in the position shown in FIGS. 3 and 4. The motor 115 is then energized to cause the drive mechanism shown in FIGS. 7 and 8 to drive the upper plate 33. This moves the test contact 25 along the first row of the components 23 in the holder 19 and correspondingly moves the air nozzle assembly 103 along the vertical columns of the memory members 67. At the first contact 57, the testing apparatus 27 rapidly performs the selected tests of the associated component 21 and provides a signal to an appropriate one of the solenoid valves 107 (FIGS. 3 and 4) to move the appropriate memory member 67 of the adjacent column of memory members to the extended position. In this manner, the sorting means is programmed in accordance with the test results. This programming process is repeated for each of the components 21 in the first row of components.

After all of the components 21 in the first row have been tested, the sequence programmer 151 (FIG. 6) provides a signal to the actuator 58 which moves the release plate 47 an amount sufficient to allow all of the components 21 of the first row of components to be dropped into their associated component passages 89. Each of the components 21 falls along the associated component path until it strikes the deflecting surface 79 of the memory member 67 which has been moved to the extended position. The deflecting surface 79 deflects the component 21 into the associated passage 93 which directs that component to the associated collection zone 95 (FIG. 3). Thus, sorting of the tested components is accomplished automatically and in an extremely short period of time, i.e., the time required for the components 21 to fall a few inches beneath the holder 19.

After the sorting operation, the sequence programmer 151 provides a signal for operating the actuator 113 (FIG. 4) which in turn operates the reset member 83 to move the memory members 79 which are in the extended position back to the retracted position. This is accomplished with a rapid reciprocating movement of the reset member 83.

Next, the sequence programmer 151 provides a signal to the solenoid 187 (FIG. 7) to retract the detent 185 to permit one revolution of the one revolution clutch 175 and the shaft 161. This indexes the lower plate 31 to move the test contact 25 into alignment with a second row of the components 21. In addition, the sorting means 59 and the air nozzle assembly 103 are also correspondingly indexed. The operation is then repeated except that the test contact 25 moves in the opposite direction over the second row of the components 21.

The test contact 25 is preferably moved continuously rather than intermittently. To provide a brief interval at the end of each row for component sorting and indexing of the lower table 31, without having to stop the motor 115, the test contact 25 travels slightly beyond the end of each row of the contacts 57.

The operational sequence described above can be varied. For example, once the components 21 which are released from the holder 19 enter the component paths 89, the indexing of the lower plate 31 can begin. Reset of the memory members 67 can occur any time between the sorting operation and the test of the first component in the second row.

After all of the components 21 in the holder 19 have been tested, the motor 115 is reversed, either manually or by the sequence programmer 151. With the motor being driven in reverse, the shaft 127 (FIG. 7) and hence the upper plate 33 are not being driven because the one-way clutch 137 free wheels. However, the shaft 161 is rotated continuously by the pulley 171 and the one-way clutch 173 to return the lower plate 31 back to the initial position so that a new group of components 21 can be tested in the holder 19. During the return movement of the lower plate 31, the tab 183 cams the detent 185 out of the way against the biasing action of the spring 189, such camming being made possible by inclined cam surfaces (not shown) which are operative in this direction of rotation. Accordingly, the detent 185 does not prevent rotation of the shaft 177 in the direction necessary to return the lower plate 31 to the initial position.

Although reference is made herein to testing of the components 21, it should be understood that various other operations could be performed on the components in addition to, or in lieu of, testing. The contact member 25 and/or the holder 19 may be movable relative to the supporting structure 29.

Although an exemplary embodiment of the invention has been shown and described, many changes, modifications and substitutions may be made by one with ordinary skill in the art without necessarily departing from the spirit and scope of this invention.

I claim:

1. A component sorting apparatus useable with a testing apparatus wherein the testing apparatus is adapted to test components, said component sorting apparatus comprising:

a supporting structure;

holding means on the supporting structure for holding a plurality of components to be tested at holding locations, respectively, said apparatus having a plurality of component paths beneath at least preselected ones of said holding locations, respectively;

said holding means including movable means for releasing the components at said preselected holding locations from the holding means to allow such components to move under the influence of gravity along the associated component path away from the holding means;

means defining a plurality of separate zones accessible from said component path;

programmable means on the supporting structure responsive to the results of the test of each of the components at said preselected holding locations for directing the components from said component paths into said zones in accordance with the test results; and said movable means including a plate beneath the holding locations for retaining the components in the holding means, said plate being movable to leave the components at said preselected holding locations unsupported and free to fall along their associated component paths.

2. A component sorting apparatus as defined in claim 1 wherein said holding locations are arranged in a plurality of rows on said holding means, said movable means beng movable to sequentially release the rows of components in the rows of holding locations.

3. A component sorting apparatus as defined in claim 1 wherein said holding locations and component paths are each arranged in a plurality of rows, said programmable means being movably mounted on said supporting structure so that it can be sequentially used for different rows of components.

4. A component sorting apparatus as defined in claim 3 wherein said programmable means includes a mounting member on the supporting structure and a plurality of movable members mounted on said mounting member for movement relative thereto, said movable members being adjacent one of said rows of component paths, said mounting member being movable relative to said supporting structure to position the movable members adjacent another of said rows of components, said apparatus includes means responsive to the test results for controlling the position of the movable members, said movable members controlling which of said zones the components are directed into.

5. A component sorting apparatus as defined in claim 4 wherein said movable members are arranged in a plurality of columns with said columns extending along the component paths, respectively, of said one row of component paths.

6. A component sorting apparatus useable with a testing apparatus wherein the testing apparatus is adapted to test a component and the component is movable along a component path, said component sorting apparatus comprising:

means defining a plurality of collection zones;

means defining a plurality of passages, each of said passages leading from the component path to one of the collection zones;

programmable means responsive to the results of the test of the component for directing the component from said component path into one of said passages whereby the component is placed in the appropriate collection zone, said programmable means including a plurality of fluid responsive linearly movable members;

means for mounting each of said movable members for movement along a substantially linear path; and means responsive to the results of the test for providing fluid under pressure to control the position of the movable members, the position of the movable members controlling the collection zone into which the component is directed.

7. A component handler comprising:

a supporting structure;

a motor on the supporting structure;

an endless flexible element;

means for mounting the endless flexible element on said supporting structure for movement along a continuous path;

means for drivingly coupling the motor to the endless flexible element whereby the motor can drive the endless flexible element;

a drive element carried by the endless flexible element;

a driven element having a slot therein adapted to receive the drive element;

a holder member for holding a plurality of components to be tested in a plurality of rows;

a scanning member;

means for coupling one of said members to the supporting structure;

means for coupling the other of said members to said driven element whereby said other member can be moved in opposite directions without reversing said motor and the scanning member and the holder member are moved relative to each other to allow the components in the holder member to be scanned by the scanning member; and means for relatively moving said members in a direction to permit successive rows of components in the holder member to be scanned by the scanning member.

8. A component handler as defined in claim 7 wherein the component handler is adapted for use with a testing apparatus and the component handler includes a fluid responsive memory adapted to be programmed in accordance with the test results of the components, means for providing fluid under pressure in response to the results of the tests for programming the memory, at least one of said memory and said last mentioned means being drivingly coupled to said driven element to provide relative movement between the last mentioned means and the memory.

9. A component handler as defined in claim 7 wherein said last mentioned means includes a one revolution clutch driven by said motor.

10. A component handler as defined in claim 7 wherein said last mentioned means is driven by said motor.

11. A component handler comprising:

a supporting structure;

a motor on the supporting structure;

a holder member for holding a plurality of components in a plurality of rows on which an operation is to be performed;

a scanning member;

means driven by said motor as the motor rotates in a first direction for relatively moving said holder member in both directions along a first path parallel to said rows whereby the components can be scanned by the scanning member; and means driven by said motor for relatively moving said members in one direction along a second path extending transverse to said rows whereby successive rows of components can be scanned by said scanning member.

12. A component handler as defined in claim 11 wherein said last mentioned means is driven by said motor as the motor rotates in said first direction to relatively move said members along said second path.

13. A component handler as defined in claim 11 wherein said motor is reversible and including means responsive to said motor rotating in a second direction opposite to said first direction for relatively moving said members in the other direction along said second path without relatively moving said members along said first path whereby said members can be returned to a starting position.

* * * * *